United States Patent [19]

Sajfert

[11] 4,073,526

[45] Feb. 14, 1978

[54] LOCK ARRANGEMENT FOR A MOTOR VEHICLE DOOR

[75] Inventor: Drago Sajfert, Wolfsburg, Germany

[73] Assignee: Volkswagenwerk Aktiengesellschaft, Wolfsburg, Germany

[21] Appl. No.: 709,913

[22] Filed: July 29, 1976

[30] Foreign Application Priority Data

Aug. 16, 1975 Germany ..... 2536431

[51] Int. Cl.[2] ..... E05C 21/00

[52] U.S. Cl. ..... 292/347

[58] Field of Search ..... 292/347, 336.3, 1, 216, 292/280, DIG. 53, DIG. 24, DIG. 25

[56] References Cited

U.S. PATENT DOCUMENTS

| | | | |
|---|---|---|---|
| 2,873,135 | 2/1959 | Haltenberger | 292/216 X |
| 3,140,888 | 7/1964 | Di Salvo | 292/216 X |

*Primary Examiner*—Richard E. Moore
*Attorney, Agent, or Firm*—Spencer & Kaye

[57] ABSTRACT

Lock arrangement for a door, particularly a motor vehicle door of the type including a lock mechanism mounted in the door and having a latch member which cooperates with a lock member fastened to a door column of the vehicle, a safety device, including a pivotal lever, associated with the lock mechanism, and an actuator for the safety device which is releasably connected at its end facing the lock mechanism with a region of the pivotal lever which is oriented at least approximately in the installation direction of the lock mechanism. The end of the actuator for the safety device is supported in the installation direction of the lock mechanism and the releasable connection between the actuator and the pivotal lever is a plug-in connection.

9 Claims, 3 Drawing Figures

LOCK ARRANGEMENT FOR A MOTOR VEHICLE DOOR

BACKGROUND OF THE INVENTION

The present invention relates to a lock arrangment for a door, particularly a motor vehicle door. More particularly the present invention relates to such a lock arrangement including a lock mechanism which is mounted in the door and includes a latching member which cooperates with a lock member fastened to a door column or post of the vehicle, a safety device, including a pivotal lever, associated with the lock mechanism, and an actuator for the safety device, with the end of the actuator facing the lock mechanism being releasably fastened to an area of the pivotal lever which is oriented at least approximately in the direction of installation of the lock mechanism in the door. Such a lock arrangement is disclosed in German Offenlegungsschrift (Published Patent Application) No. 2,153,707 which corresponds to U.S. Pat. No. 3,844,595, issued Oct. 29th, 1974, to Helmut Meinow, the subject matter of which is incorporated herein by reference. It it the object of this known arrangement, as well as of the present invention, to provide a lock arrangement in which the lock mechanism in the door can be installed solely from the frontal face of the door, i.e., without the need for accessibility from the side. In other known lock arrangements it is necessary, particularly in order to produce a connection between the actuator for the safety device and the pivotal lever which is part of the safety device, to remove the interior lining of the door.

This problem is solved by the lock arrangement of the above-mentioned patent in that the connection between the actuator and the pivotal lever of the safety device is made releasable and is placed at a freely accessible location, and that furthermore the actuator is designed to permit establishment of the connection before attachment of the lock mechanism to the frontal face of the door. In detail, the known arrangement provides that the actuator includes an actuating rod which is pivotally connected with the safety device and which, once it has been connected with the safety device, can be threaded through an opening in the frontal face of the door and into the door.

Whereas the establishment of the connection of the actuator for the lock itself with the lock mechanism generally does not prove difficult even without lateral accessibility because this actuator can be made of any desired length in the form of a Bowden cable, the installation of the actuator for the safety device, particularly the connection between the two, is much more difficult. This is so because, as described above, the actuator for the safety device generally includes a rod-like member which in the known motor vehicle doors ends in a handle or knob directly below the window of the door and is mounted there.

SUMMARY OF THE INVENTION

It is therefore the particular object of the present invention to provide a lock arrangement of the above-mentioned type which is designed so that the connection between the actuator for the safety device and the pivotal lever of the safety device can be established without additional manipulation during installation of the lock mechanism into the door. The installation of the lock mechanism is here intended to include the countersunk installation into a recess or bent portion of the door frontal panel, as well as placing the lock mechanism onto the door frontal panel.

The above object is basically achieved according to the present invention in that in a lock arrangement of the above identified type for a door, the end of the actuating means for the safety device is supported in the door in the direction of installation of the lock mechanism into the door, and the realeasble connection between the actuator and the pivotal lever of the safety device of the lock mechanism is a plug-in connection.

In the lock arrangement according to the invention the connection between the safety device and its actuator is thus effected automatically as soon as the lock mechanism is moved in the direction of its installation in the door, i.e., in that direction relative to the door which is required to move the lock mechanism into its final installed position. Conversely, this connection is automatically released if — for example for purposes of repair — the lock mechanism is removed from the door.

According to a feature of the invention the end of the actuating means for the safety device is permitted to pass through a slot in the door metal and is provided with a collar for supporting the actuating means on the door metal against movement in the direction of installation of the lock mechanism into the door i.e., in a direction toward the interior of the door. Support in the opposite direction will generally not be required since a corresponding collar or the like may impede the pivotal movement of the end of the actuator required to operate the safety device and, moreover, may make insertion of the actuator from the frontal side of the door through a recess in the door metal more difficult.

So as to be able to provide the pivotal lever as a simple stamped member or — as will be described below in the description of a preferred embodiment — in the form of a bent wire, it is advisable to design the end of the actuator as a sleeve with a receptacle for the then somewhat pin-shaped cooperating region of the pivotal lever. In principle it is of course also possible to design the region of the pivotal lever which forms the connection as a sleeve with a receptacle for the then somewhat pin-shaped end of the actuator.

A further favorable characteristic of the present invention is that it can be adapted substantially to the basic structure of the lock mechanism, particularly to the pivot plane of the pivotal lever. For this purpose, according to a further feature of the invention the actuating means is designed to include a plurality of parts or members, i.e., so that it includes a rigid member forming the end which is connected to the pivotal lever and rod-shaped member which is provided with a handle and which is articulated to the rigid member. The rod-shaped member thus again leads to the lower edge of the window in a motor vehicle door. The above-mentioned articulated connection can now lie on the axis of the plug-in connection of the pivotal lever and the rigid member of the actuating means for the safety device, and in this case the pivot movement takes place in a plane including this axis. It is also possible, however, for the articulated connection between the two members of the actuating means to lie next to the axis of the plug-in connection between the pivotal lever and the actuating means for the safety device and to define a lever arm with respect to this axis. However, in this case the pivot axis extends perpendicularly to the axis of the connection.

DETAILED DESCRIPTION OF THE PREFERRED EMBODIMENTS

Figure 1:
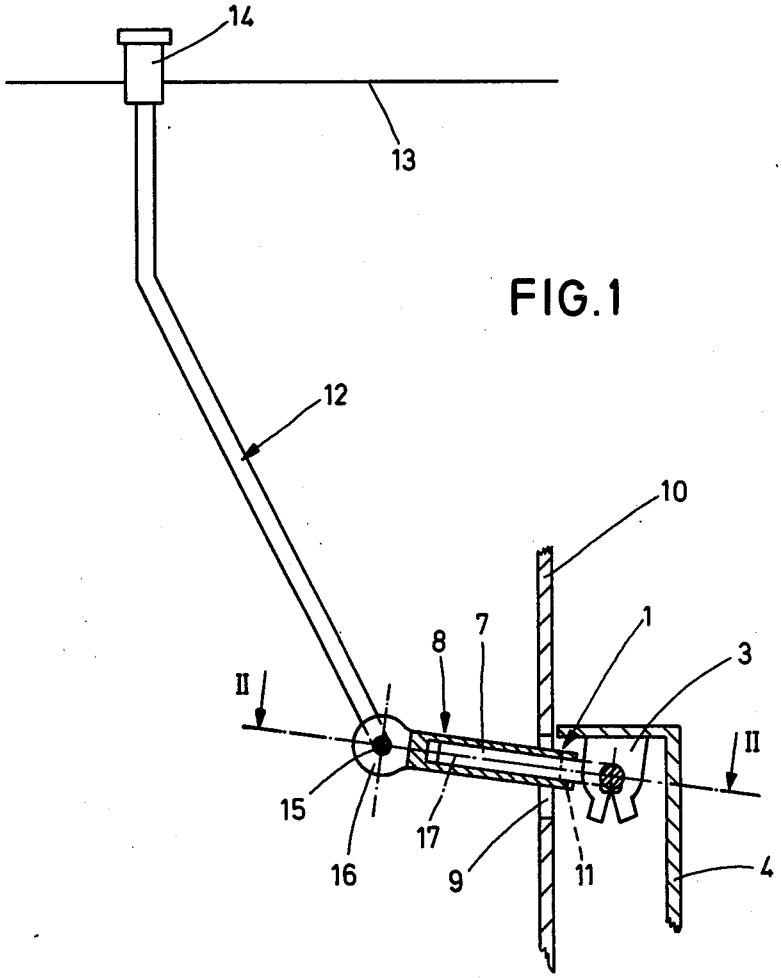
FIG. 1 is a schematic side view, partially in section, of a portion of a lock arrangement illustrating one embodiment, according to the invention, of the pivotal lever of the safety device of the lock arrangement and the actuator for the safety device.
Figure 2:
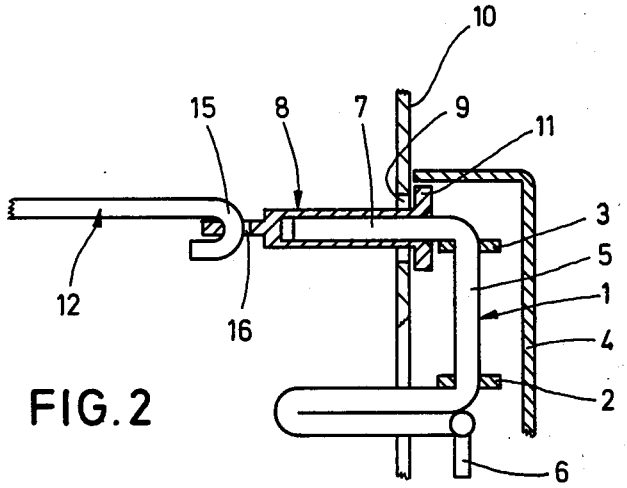
FIG. 2 is a schematic top view, partially in section in the direction of the line II—II of FIG. 1.
Figure 3:
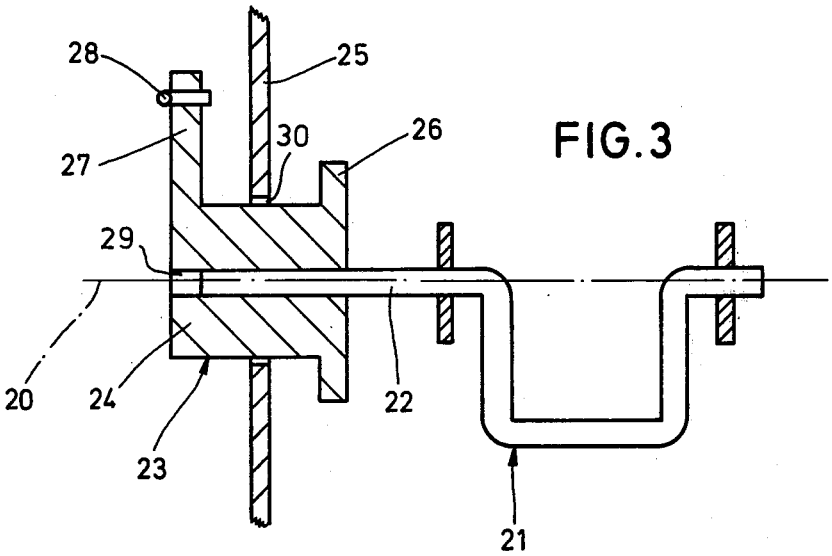
FIG. 3 is a schematic partially sectional view corresponding to that of FIG. 2 showing another embodiment of the invention.

Before discussing the specific embodiments of the invention shown in the figures it should be noted that FIGS. 1–3 show only those parts of the lock arrangement which are of significance for the invention. Thus the latch member in the lock mechanism on the edge of the door and the associated actuating means are not illustrated since such latch members, which are generally trap locks, as well as the corresponding actuating means are known in large numbers from the patent literature. The same applies for the lock member fastened to the door column which is generally designed as a known clamp.

Referring now to FIGS. 1 and 2, the pivotal lever 1 of the safety or locking device of the lock mechanism is simply a bent wire. The pivotal lever 1 is pivotally mounted, by means of eyes 2 and 3, to the housing 4 of the lock mechanism which is screwed, for example, to the frontal surface of the door. Such structures are also state of the art.

The pivotal lever 1, as seen in FIG. 2, includes, in addition to its center bearing area 5, a lower end 6 with which it engages in a safety lever (not shown) of the lock mechanism, as well as an upper end 7 which is engaged and held in the axial bore of a socket member 8 to form a plug-in connection. Socket 8 passes through a recess or opening 9, which in the illustrated embodiment is a vertical slot, in a metal wall 10 of the door and is supported against movement in the direction of installation of the lock mechanism contained in housing 4, i.e., toward the interior of the door, by means of collar 11 formed on the socket 8 and which can abut on the metal wall 10. The socket 8, which a shown, is a rigid member, forms the end of the actuator or actuating means for the safety device which faces this part of the lock mechanism. The remainder of the actuating means for the safety device, i.e., the means for pivoting the pivotal lever 1, includes a rod-shaped member 12 and an actuating or operating knob or button 14. As can be seen in FIG. 1, the rod-shaped member 12 is guided obliquely upwardly to the lower edge 13 of the window of the door where the actuating knob 14 is fastened, e.g., by a screw connection. As shown, the two members 8 and 12 are articulated together by means of a joint connection. For this purpose the rod-shaped member 12 is provided with a hook-shaped end 15 which passes through the eye-shaped region 16 of socket 8. In the illustrated embodiment, the pulled-up position of the actuating knob 14 corresponds to the unsecured state of the pivotal lever 1, while the depressed position of the knob 14 corresponds to the secured position of pivotal lever 1. With this arrangement the pivot plane thus includes the axis 17 of the plug-in connection formed by the end 7 of lever 1 and the socket 8.

In contradistinction to the embodiment of FIGS. 1 and 2, in the embodiment of FIG. 3 the pivot plane is perpendicular to the axis 20 of the plug-in connection, which axis here is identical with the pivot axis of the pivotal lever 21 of the safety device. Since the actuating forces in this embodiment act in the peripheral direction, the pin or plug-like end region 22 of this lever 21 must, in this case, be appropriately profiled so that it can be engaged in the correspondingly profiled recess or bore 29 in sleeve member 23 to prevent relative rotation therebetween. The sleeve or socket member 23 in this embodiment has substantially three regions 24, 26 and 27. The cylindrical region 24 is rotatably passed through a recess or opening 30 in the metal wall 25 of the door. On the side of the metal wall 25 facing the pivotal lever 21, the rigid member 23 is provided with a collar 26 with which it is supported on the metal door wall 25 in the direction of installation of the lock mechanism, i.e., from the right to the left in FIG. 3. On the other side of the wall 25, the rigid member 23 is provided with a transversely extending arm 27 which serves to produce the connection joint with the rod-like member 28 of the actuating means for the safety device of the lock arrangement.

In both embodiments of the invention it is assured that the establishment of the connection between the actuating means for the safety device and the pivotal lever of the safety device takes place automatically when the lock mechanism is moved together with the pivotal lever in the installation direction, and that this connection is released, likewise automatically, when the lock mechanism is removed from the door by movement in the opposite direction. It is thus not necessary to remove the inner lining of the door to release or establish, respectively, this connection.

The actuating means can also be supported in a different manner. For example, the support may be provided by appropriate guides for the rod-like member 12 or 28 formed in the door.

It will be understood that the above description of the present invention is susceptible to various modifications, changes and adaptations, and the same are intended to be comprehended within the meaning and range of equivalents of the appended claims.

What is claimed is:

1. In a door having a lock arrangement mounted thereon, said lock arrangement including a lock mechanism mounted in said door and having a latch member which cooperates with a lock member fastened to a door column, a safety device, including a pivotal lever, associated with said lock mechanism, actuating means for said safety device, and means for releasably connecting the end portion of said actuating means facing said lock mechanism with a region of said pivotal lever which is oriented at least approximately in the direction toward the interior of said door; the improvement wherein: said actuating means includes a rigid member forming said end portion and a rod-shaped member which is articulated to said rigid member and is provided with an operating handle; means are provided for supporting said end portion of said actuating means against movement in the direction toward said interior of said door; and said means for releasably connecting said actuating means to said pivotal lever is a plug-in connection.

2. A lock arrangement as defined in claim 1 wherein said means for supporting said end portion of said actuating means supports same only against movement in the direction away from said lock mechanism.

3. A lock arrangement as defined in claim 1 wherein said plug-in connection comprises a socket having a hollow bore and a pin engaged in said bore, one of said socket and said pin constituting said end of said actuating means and the other of said socket and said pin constituting said region of said pivotal lever.

4. A lock arrangement as defined in claim 3 wherein said socket constitutes the end of said actuating means and said pin constitutes said region of said pivotal lever.

5. A lock arrangement as defined in claim 3 wherein said means for supporting said end portion of said actuating means includes an opening which is formed in the door metal and through which said end of said actuating means passes and a collar formed on said end portion of said actuating means on the side of the door metal which faces said lock mechanism and which abuts said door metal when moved in the direction toward said interior of said door.

6. A lock arrangement as defined in claim 1 wherein said rod-shaped member is articulated to said rigid member via a connection joint; and wherein said connection joint is disposed on the axis of said plug-in connection.

7. A lock arrangement as defined in claim 1 wherein said rod-shaped member is articulated to said rigid member via a connection joint; and wherein said connection joint lies next to the axis of said plug-in connection and defines a lever arm with respect to said axis.

8. A lock arrangement as defined in claim 7 wherein said rigid member includes a cylindrical region whose longitudinal axis constitutes the axis of said plug-in connection and which is provided with a transverse arm which constitutes said lever arm; and said means for supporting said end portion of said actuating means comprises an opening which is formed in the door metal and through which said cylindrical region of said rigid member passes so that said transverse arm is on the side of the door metal facing away from said lock mechanism, and a collar formed on said cylindrical region of said rigid member and disposed on the side of the door metal facing said lock mechanism.

9. A lock arrangement as defined in claim 8 wherein said plug-in connection comprises a longitudinal bore in said rigid member, and a pin like extension on said pivotal lever which is engaged in said bore.

* * * * *